United States Patent [19]

McDermott et al.

[11] Patent Number: 4,694,281

[45] Date of Patent: Sep. 15, 1987

[54] VISUAL ALARM APPARATUS

[76] Inventors: Julian A. McDermott, 1639 Stephen St., Ridgewood, N.Y. 11385; Jewel Verde, 2137 Hallmark Dr., Gambrille, Md. 21054; Wayne McDermott, 2324 A E. 43 St., Apt. 5, Erie, Pa. 16510

[21] Appl. No.: 789,754

[22] Filed: Oct. 21, 1985

Related U.S. Application Data

[63] Continuation of Ser. No. 418,932, Sep. 16, 1982, abandoned.

[51] Int. Cl.[4] ..... G08B 19/00; G08B 3/00

[52] U.S. Cl. ..... 340/521; 340/691; 340/693; 340/331

[58] Field of Search ..... 340/521, 522, 524, 525, 340/635, 693, 691, 330, 331, 332, 309.4, 310 R

[56] References Cited

U.S. PATENT DOCUMENTS

| | | | |
|---|---|---|---|
| 3,810,170 | 5/1974 | Zinsmeister | 340/331 |
| 3,965,468 | 6/1976 | Bronson | 340/331 |
| 4,042,919 | 8/1977 | Patty | 340/321 |
| 4,047,165 | 9/1977 | Andreasson et al. | 340/331 |
| 4,263,588 | 4/1981 | Gauties | 340/321 |
| 4,283,657 | 8/1981 | Gorden et al. | 340/691 |
| 4,290,057 | 9/1981 | Knight | 340/539 |

*Primary Examiner*—Donnie L. Crosland

*Attorney, Agent, or Firm*—Eugene F. Osborne, Sr.

[57] ABSTRACT

A lighting device for a room environment, in a form of a table, ceiling or swag unitary fixture, provides primary illumination for general living and working activities within the space of a room, subject to the on-off control of persons therein; flashing illumination occurring at repetition rates designated for alerting persons, including individuals having impaired hearing abilities, to specific fire, burglar or other alarm conditions, responsive to local or supervised control sensors; and supplemental signaling illumination for communicating instructional information.

13 Claims, 9 Drawing Figures

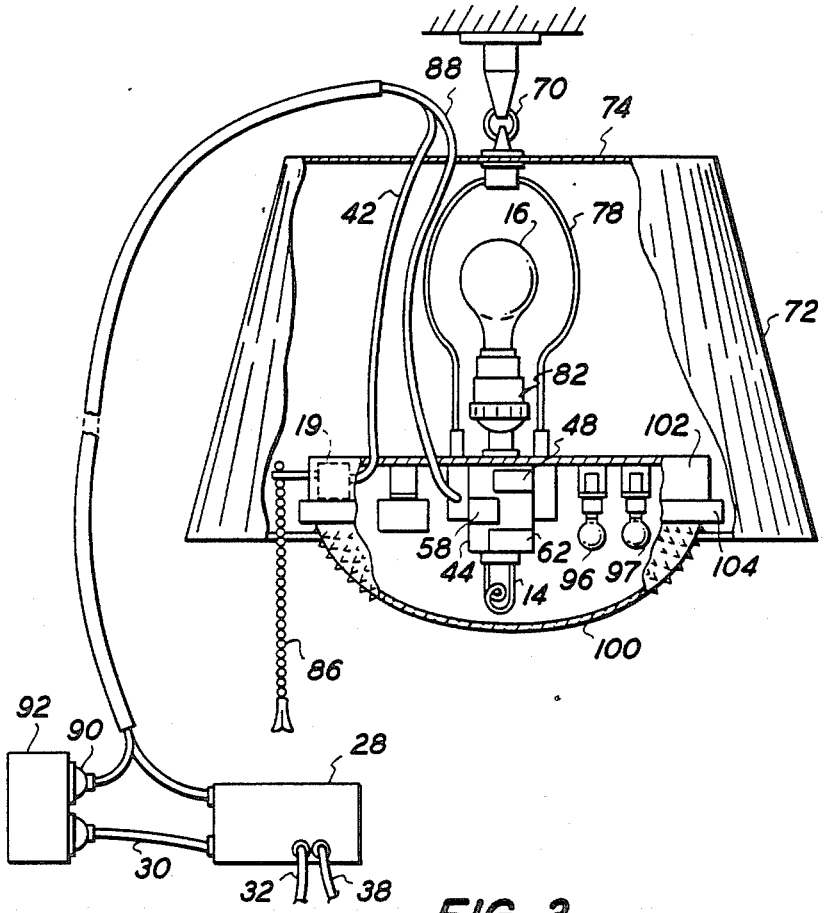
FIG. 3
FIG. 4
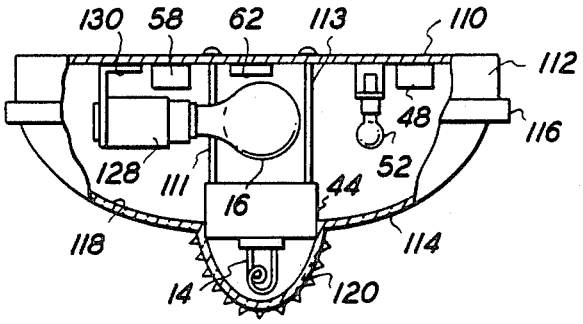

VISUAL ALARM APPARATUS

This is a continuation of application Ser. No. 418,932 filed Sept. 16, 1982, now abandoned.

The present invention relates to apparatus for providing visual alarms and general illumination; in particular, such alarms as may be used to alert hearing impaired, including deaf, persons as to the existence of fire or burglar hazards as well as for signaling and alerting such persons for other purposes.

The invention is especially suitable for providing a lighting fixture, whcih may be in the form of a table lamp, a suspension, swag or hanging lamp or a ceiling mounted lamp which produces visual alarms and signaling as well as general illumination, while blending into the residential, home environment.

The invention produces visual alarms and visual signaling through the use of a strobe lamp in the general manner described in U.S. Pat. No. 3,810,170 issued May 7, 1974 to R. F. Zinsmeister. The Zinsmeister patent describes a visual signaling system for rooms which are occupied by hearing impaired persons. A room signal indicator is installed on the wall of the room. The indicator contains a strobe lamp. Circuitry associated with the strobe lamp is tied into the fire alarm system as well as to other signaling system in the facility. The hearing impaired person is alerted to fire alarms and other signaling conditions by the activation of the strobe lamp.

This invention provides lighting for purposes similar to the apparatus of the Zinsmeister Patent which, however, requires no substantial installation, is compatible with residential surroundings and may also indicate the nature of the hazard by coding of flashing constituting the visual alarm.

The system described in the Zinsmeister patent is designed for use in institutions such as schools and dormitories. It is desirable that strobe lamp alarm and signaling systems be provided that are generally useful in other environments, especially in homes and in residential areas. Then it becomes necessary and desirable that the alarms and signaling system be compatible with the surroundings. Such compatibility has been provided in accordance with this invention by providing lighting apparatus which combines the visual alarm and signaling function with the general lighting function into a unitary structure of the type commonly referred to as a lamp or lighting fixture.

Accordingly it is a principal object of the present invention to provide improved visual alarm and signaling apparatus.

It is another object of the invention to provide improved visual signaling apparatus especially suitable for residential and home use.

It is a further object of this invention to provide improved apparatus associated with a lighting device providing both a visual alarm and illumination from that lighting device.

It is a still further object of the invention to provide improved apparatus which affords visual alarm and general illumination in a unitary structure, of the type normally used in a residential environment as a lighting fixture.

It is a still further object of the present invention to provide an improved lighting fixture containing a strobe lamp and a general illumination lamp wherein the light from the general illumination lamp is diffused while the high intensity from the strobe lamp is substantially fully transmitted such that the signaling and alarm function and the general illumination functions complement and do not detract from each other.

It is a still further object of the present invention to provide an improved lighting fixture which combines a strobe lamp and a general illumination lamp wherein the general illumination does not mask the light from the strobe lamp or interfere with the signaling and alarm function of the strobe lamp.

It is a still further object of the present invention to provide improved apparatus for visual alarm and signaling and for general illumination which also provides an indication of the nature of the signal or alarm conditions.

It is a still further object of the present invention to provide improved visual alarm apparatus having a lamp which is operated to provide a sequence or timing of flashes to indicate different alarm and signaling conditions.

It is a still further object of this invention to provide improved lighting apparatus wherein both visual alarm and illumination from the same lighting device.

Briefly described, apparatus for providing visual alarms and general illumination which embodies the invention has a unitary structure including a strobe lamp, a general illumination lamp and a lighting fixture. The strobe lamp and general illumination lamp are mounted spaced from each other within the lighting fixture. An electrical wiring circuit connected to the general illumination lamp supplies power thereto, providing for continual illumination. Another electrical circuit connected to the strobe lamp activates the strobe lamp upon command to provide a visual alarm. The term visual alarm is inclusive of various signaling functions, as well as fire, burglar or other hazard alarms.

The foregoing and other objects, features and advantages of the invention as well as presently preferred embodiments thereof will become more apparent from a reading of the floowing description in connection with the accompanying drawings in which:

FIG. 3 is a partially sectional front view, a suspension, swag lighting fixture embodying the invention;

FIG. 4 is a partially sectional, front view of a globe lighting fixture, which embodies the invention;

Figure 1:
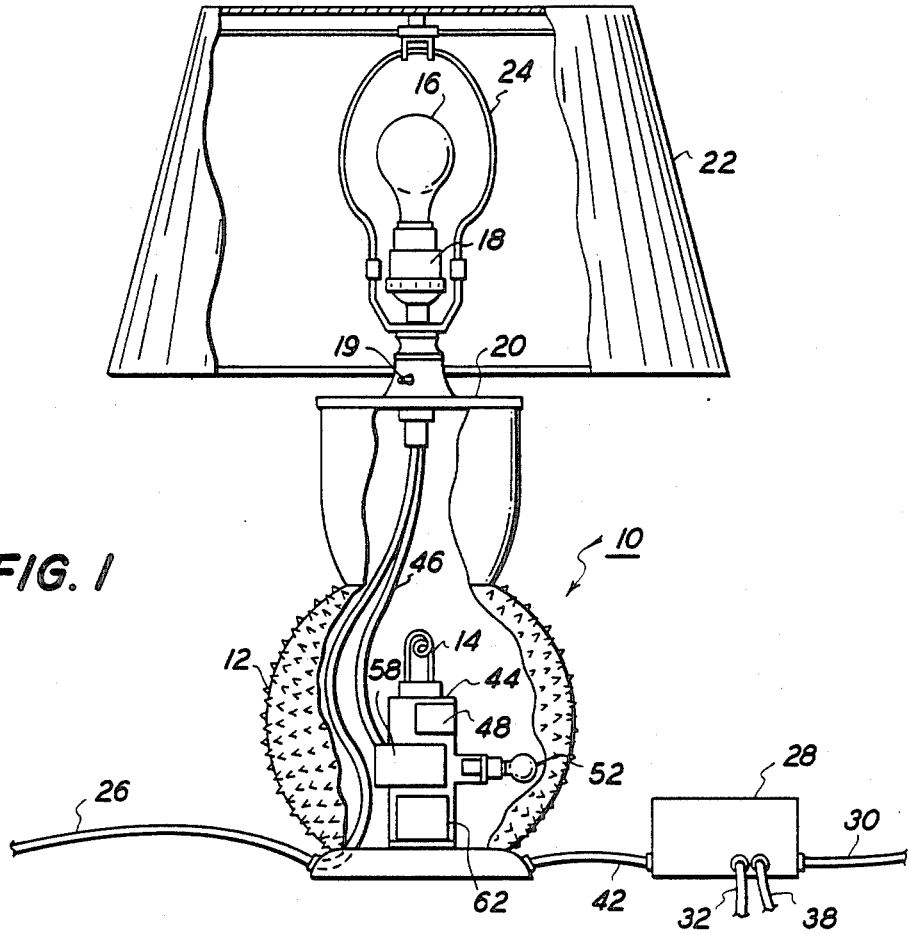
FIG. 1 is a partially sectional front view of a table lamp lighting fixture embodying the invention.

Referring to FIG. 1, there is shown a table lamp lighting fixture having a base 10 which is hollow. The lower portion of the base 10 is globular and of light transmitting material, such as glass, preferably with crystalline formations 12 on its surface. These formations provide for specular transmission of light from a strobe lamp 14 which is mounted within the globular portion of the base 10. The base 10 is the container for the strobe lamp 14.

A general illumintion lamp 16 is illustrated as an incandescent lamp. Fluorescent or other general illumination lamps may also be used. The general illumination lamp 16 is disposed in a socket 18 mounted on a cover plae 20 which closes the top of the base 10. A diffuser in the form of a shade 22 around the lamp 16 is mounted on the base 10 by means of a harp 24. It is desirable that the shade 22 by translucent; although the shade may be opaque with light emitting through its open top and bottom. The light from the general illumintion lamp 16 is then diffused and readily distinguishable from the bright flashes of light from the strobe lamp 1. The crystalline formations 12 provide a specular effect which enhances the strobe lamp light flashes. The high intensity flashes become apparent to a hearing impaired person. The use of diffusing or partially concealing material around the general illumination lamp and non-diffusing material around the strobe lamp enhances the compatibility of these lamps and prevents any confusion between signals represented by the strobe lamp flashes and general illumination. The lighting fixture itself is of the type well known and compatible with the residential, home environment. Accordingly, general illumination and strobe signaling functions may be combined in accordance with the invention in a pleasing and functionally compatible manner.

A lamp cord 26 connected, as by a plug to the house wiring, supplies power to the general illumination lamp 16. The lamp 16 provides illumination continually. It may be shut off by a switch 19, as is conventional. The strobe lamp and other circuit components associated therewith obtain power from the power lines through a control box 28. The control box is connected to the house power, as by a line cord 30. By house power is meant the normal AC house wiring which is available at outlets in the home. The control box 28 interfaces the power for the strobe lamp with signals from the alarm system. One line 32 may be connected to emergency condition servicing means such as fire sensors 34 (represented by a switch 36 in FIG. 2) and from other signaling circuits, by a line 38 which may be connected, for example to a switch 40 as a burglary signal at the door (see FIG. 2). Power is applied by way of the line 30, the control box 28 and another line 42 to the strobe lamp and its associated circuits in the base 10 of the fixture. These circuits may be of the type generally described in the above referenced Zinsmeister patent. Such circuits include components to give voltage control, rectification and increasement as well as triggering components, all serving as auxiliaries to the strobe lamp and shown as assembly 44 on the diagram. The relays activating the strobe lamp may be found in the control box 28.

Another lamp 52, which may be a colored incandescent signaling lamp is also located in the base 10 and is illuminated to indicate which signaling condition is activated. For example, the lamp 52 may be red and become illuminated whent he fire alarm is signaled, but not when the door switch is closed. (burglary). The operation of the signaling lamp is controlled by a decoder 58.

Figure 2:
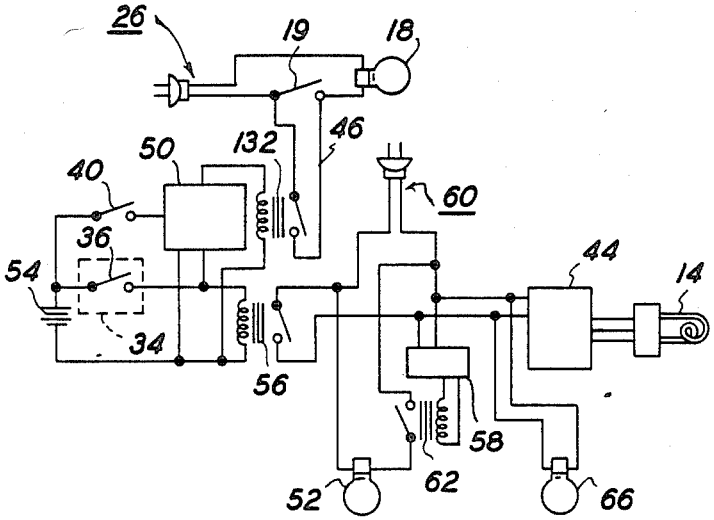
FIG. 2 is a schematic diagram of circuitry suitable for use in the apparatus illustrated in FIG. 1 as well as in the apparatus illustrated in FIGS. 3 and 4.

As shown in FIG. 2 the alarm and signaling circuits are provided with an independent power supply, illustrated as a battery 54. When a fire alarm signaling condition occurs, switch 36 closes and relay 56 closes the strobe circuitry energized from the power lines 60; thus continuously flashing the strobe.

The decoder 58 responds to the closure of switch 36 and the uninterrupted power by closing relay 62 and causing the signal lamp 52 to light. If this signal lamp were red, fire would be indicated.

If, however, alarm sensor switch 40 were closed instead of switch 36, the encoder 50 causes the relay 56 to program the strobe circuitry to a series of groups of pulses (or some other arrangement). The encoder prevents the signal lamp 52 from lighting; thus, further distinguishing the basic signals.

The hearing impaired person can readily distinguish between the type of flashing of the strobe. The encoding produces a slow timed series of groups of flashes of any duration to the group down to a "series" of single flashes which would be in effect a slower flashing strobe.

If a simpler arrangement having only one type of alarm, (perhaps fire) the coding circuit is not used. Instead a lamp 66 may be used to give a red light identification when the strobe starts to operate.

As a means of adding additional effectiveness to the device, the illuminating lamp (16 FIG. 1) may be flashed along with the strobe. This can be accomplished by including with the encoder 50 a relay 132 to control the illuminating lamp using wiring 46 to bypass the lamp switch 19.

Referring to FIG. 3 there is shown a suspension, swag lamp fixture embodying the invention. This fixture is hung or suspended from the ceiling by means of a chain or a ring and socket coupling 70 as shown in FIG. 3. A diffusing or partially concealing shade 72 is suspended by its frame 74, which is attached to the coupling 70. Such shades can effect diffusion by having an opaque body to let the light emit only from the top and bottom thereof. A cover plate 76 is also suspended from the coupling 70 by means of a harp 78. A general illumination lamp 16 shown as an incandescent lamp, is mounted in a socket 82 also supported on the plate 76. A switch 19, operated by a pull chain 86, is used to turn power to the illumination lamp on and off. Power is applied by way of a lamp cord 88 which is connected through the house wiring by way of a plug 90, which is inserted into an outlet 92.

Also mounted on the support plate 76 is a strobe lamp 14 and indicator lamps 96 and 97, which may be different color incandescent lamps, such as the lamps 52 and 66 described in connection with FIG. 2 above. The other circuitry associated with the strobe lamp is also mounted on the plate 76. A glass or otherwise light transmitting globe 100 is attached to a collar 102, which is attached to the plate 76. The ring 104 attaches the globe 100 to the collar 102. The globe may have a crystalline surface formation to obtain a specular effect ont he transmitted light from the strobe lamp 14. The shade 72 surrounds the general illumination lamp 16 so that the light from that lamp 16 is of a different nature than the flashes from the strobe lamp 14. The different characteristics of the light from the shade 72 and globe 100 make the strobe lamp highly visible and distinguishable from the general illumination.

The globe 100 is generally hemispherical. Other globe configuration, such as entirely spherical globes, may also be used. The term globe should not be taken as restrictive of the shpe of the container for the strobe lamp 14. The circuit for operating the strobe lamp is similar to the circuit shown in connection with FIGS. 1 and 2 and like parts are identified by like reference numerals.

Referring to FIG. 4, there is shown a lighting fixture which is adapted to be mounted on or hung from the ceiling. This fixture includes a support plate 110 having a collar 112. A globe 114 is connected to the collar by means of a ring 116. The ring 116, like the ring 104 (FIG. 3) may be spring loaded to allow removal of the globe so as to permit changing of the lamps therein.

The globe 114 has a generally hemispherical portion 118 and a central portion 120 which is a generally hemispherical, bulbous, projection from the portion 118. The central portion 120 is of transparent material such as glass. The portion 120 desirably has a crystalline formation to provide the specular effect for the transmission of light from a strobe lamp 14 which is disposed therein. The strobe lamp circuitry 44 is attached to the plate 110 by depending brackets 111 and 113. The strobe lamp 14 extends into the smaller, transparent hemispherical portion 120.

The general illumination lamp 16 is mounted in a socket 128. The socket is attached by a bracket 130 ot the support plate 110. The light from the lamp 16 then passes through the outer, usually diffusing portion 118 of the globe 114. The strobe lamp light passes through the transparent portion 120; thus distinguishing the strobe signals from the general illumination and allowing them to be combined in the fixture without interference. A signaling lamp 52 may also be mounted on the support plate 110 to provide color as does lamp 52 in FIG. 1. The circuitry for operating the general illumination lamp 16, the signaling lamp 52, and the strobe lamp 14 may be described in connection with FIGS. 1 and 2.

Referring to FIGS. 5 to 9, there is shown economical arrangements to use existing domestic illuminating units to provide visual alarms, all in accordance with the invention, wherein the coded flashing of the illuminating lamp itself is indicative of the alarm condition.

In its simplest form the invention provides a device which plugs into a wall outlet, and is connected to a floor or table lamp and to a smoke alarm. The device changes the operation of the lamp from steady to flashing or puts the lamp "on" flashing even if it were turned off as an illuminant. The sequence of flashing can be encoded and have various meansing as a signal and various sensing devices can cause variations in the flashing.

If a number of persons must be alerted, the system can be wired in and function on a building's circuits.

Figure 5:
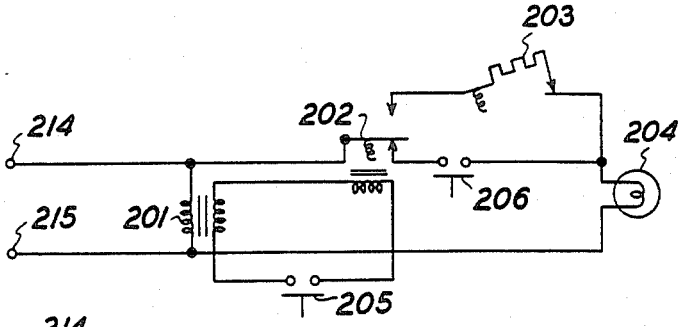
FIG. 5 is a schematic diagram of circuitry whereby the flashing of the illuminating lamp in a fixture, whether it is turned on for illumination or not, is used as an alarm signal.

FIG. 5 shows a step down transformer 201, a relay 202, a thermal flasher 203, an illuminating lamp 204, and a switch 205 activated by a smoke or other alarm demanding attention. The wall outlet terminals are shown at 214 and 215. A manual control switch 206 turns the lamp 204 on and off under normal conditions. However, should the alarm switch 205 be closed due to an alert the relay 202 makes switch 206 ineffective and the thermal flasher 203 controls thelamp 204. Thus, if the alarm required it, the lamp 204 would flash regardless of whether that lamp 204 was turned "on" or off.

Figure 6:
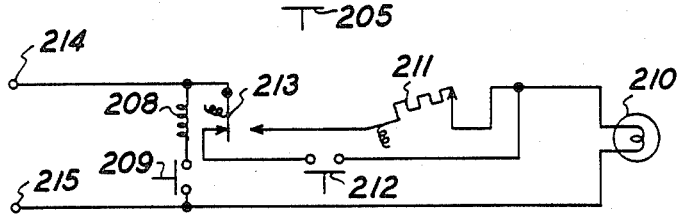
FIGS. 6 and 7 show circuitry operative similarly with of FIG. 5, but in FIG. 7 with batteries or a direct line providing power for interfcing with the sensing system.
Figure 7:
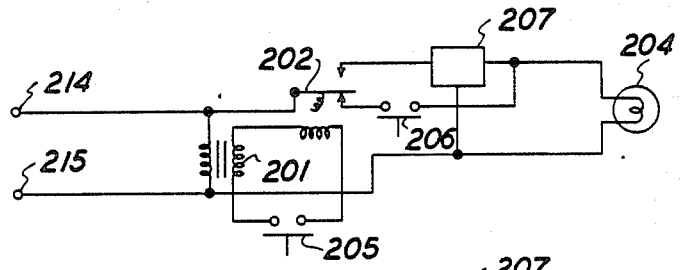

The circuit shown in FIG. 6 functions the same as the circuit of FIG. 5 except that it has a relay 208 which is operated by the full line voltage. The FIG. 6 circuit like the circuit of FIG. 5 has a switch 209 controlled by the sensing device, a flasher 211, an illuminating lamp 210 and a lamp on-off switch 212. The circuit of FIG. 7 is the same as the circuit of FIG. 5 except that a solid state, electronic flasher 207 substitutes for the thermal flasher 203.

Figure 8:
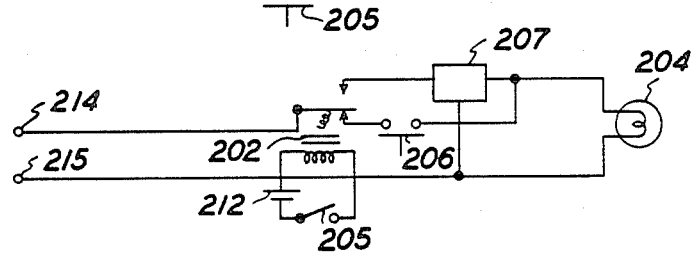
FIG. 8 shows circuitry similar to FIG. 5 but using a solid state flasher for encoding the flashing to have a specific meaning.

FIG. 8 shows a circuit which accomplishes the same results as the circuits of FIGS. 5 and 6. However, there is no step down transformer. A battery 212, used with the sensor, directly operates the relay 202.

Commercial lamp fixtures may have a switch on the socket. This switch would be locked closed and a separate manual switch used (e.g., 206 FIG. 5). This switch 206 then controls the regular use of the lamp for illumination (on-off function).

This invention is not limited to the control of individual fixtures or lamps. Multiple lamps, fixtures or even complete lighting circuits may be controlled and used as alarms. The lamp control may provide any type of flashing or other coding to indicate the nature of an alarm.

The smoke or other alarm could incorporate the switch 205 FIG. 8 (shown as part of the relay) as an integral part requiring no separate relay.

Figure 9:
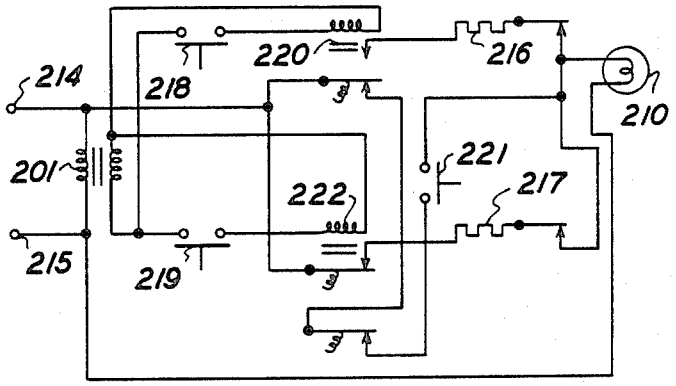
FIG. 9 shows circuitry operated by multiple sensing devices for encoding the visual alarm with various flashing sequences.

FIG. 9 shows the same general circuit as shown in FIG. 5. However, multiple sensing stations can be used for controlling the same lamp 210. The identity or type of a particular sensor is established by the various flashing devices 216 and 217 which encode the flashing differently. The switches 218 and 219 are each controlled by a different sensor. When switch 218 closes, it activates a relay 220. This opens the circuit to the lamp 210, but substitutes conduction to the lamp through the flasher 216. The switch 221 is for normal operation of the lamp 210 (on-off function).

When the sensor switch 219 closes, the relay 222 operates breaking the flow of power to the lamp 210, even if the switch 221 is closed. Power is then sent to the lamp 210 via the flasher 217. If sensors 218 and 219 represented hazards of fire and burglary, respectively, by coding the flashers 216 and 217 at known flash rates, the hazard is clearly identified.

Where a separate relay and transformer is used as in FIGS. 5 to 8, an integral unit may be substituted whereby the closing of the secondary transformer circuit establishes a magnetic field that operates an armature to operate the required contacts.

From the foregoing description it will be apparent that there has been provided improved visual alarm and signal apparatus whereby general illumination and visual signaling may be combined in a pleasing and non-interferring manner. Variations and modifications in the herein described embodiments of the invention, which are within the scope of the invention, will undoubtedly suggest themselves to those skilled in the art. For example, where the alarm lamp in many of the illustrated embodiments is shown as a strobe (which is preferred), other types of lamps distinguishable from the illumination lamps by their higher intensity or auxiliary flasher characteristics may be used. Accordingly, the foregoing description should be taken as illustrative and not in a limiting sense.

What is claimed is:

1. An electrical lighting device, comprising:

(a) a first apparatus, responsive to switching control by an attending person within a room, for general illumination of the space therein;

(b) a second apparatus, having means responsive to alert and alarm controls, for alerting and communicating information to persons, should any be within said space, comprising:

a strobe lamp for producing high intensity flashes of light exceeding the level of intensity of said general illumination for said alerting and communicating information to persons, should any then be within said space; and an enclosure for said strobe lamp comprising a partially globular shell of substantially transparent light transmitting material having a multiplicity of crystalline formations on a surface thereof for enhancement of said flashing strobe lamp; and (c) means for integrating said first and second apparatus in an unitary assembly.

2. A portable electrical lighting device, adapted for connection to house power to serve persons in a room environment, wherein the improvement comprises:

(a) a first system for general illumination of the space within said room environment, comprising:

an incandesent lamp;

a switching control for said lamp, operable by said persons to effect on-off control of said lamp; and means for diffusing the light produced by said incandescent lamp; and (b) a second system for alerting said persons, should any then be within said room environment, irrespective of the on-off status of said incandescent lamp and for communicating alarm information to said persons, comprising:

a high intensity lamp, operable in a flashing mode in a range of intensities in excess of the intensity level of illumination of said incandescent lamp and sufficient to alert hearing impaired persons within said room environment, said flashing mode responsive to alert and alarm controls;

means for applying alert and alarm controls;

means for sensing alarm conditions;

means for communicating information to said persons identifying one or multiple designated alarm conditions;

an enclosure of at least said high intensity lamp, comprising a partially globular sheel of substantially transparent light transmitting material having a multiplicity of crystalline formations on a surface there for enhancement of said flashing high intensity lamp; and (c) means for integrating said first system and that portion of said second system excluding said means for sensing alarm conditions, as remotely located, in an unitary assembly.

3. A system for domestic applications in visual alarm signaling and general illumination of residential spaces, comprising: an illuminating lamp; a source of house power for said system; an electrial switch, responsive to optional control by an attending person for on-off application of said house power to said lamp for illumination of said residential spaces; at least one automatic sensor, responsive to a designated alarm condition known to said attending person; at least one flasher, responsive to control by said sensor, for each said alarm condition, said flasher self-operable at an unique switching rate for said designated alarm condition; wherein the improvement comprises:

(a) a control relay interface subcircuit for each flasher, said relay subcircuit responsive to the application of control power by its said designated alarm sensor, comprising:

a means, in the presence of said alarm condition, for applying house power to the input of said flasher so as to periodically illuminate said lighting unit at said unique switching rate, irrespective of the then status of said elecrtrical switch; and a means, in the absence of said alarm condition, for inhibiting said flasher and for application of constant house power to said electrical switch for optional on-off control fo said lighting unit by said attending person for illumination of said residential spaces.

4. An electrical lighting and visual warning system for the living and workng zones of a room, comprising:

(a) a control box comprising means for connecting said lighting and warning system to AC house wiring for power and for interfacing an alarm and signaling system that provides electrical controls for activating said visual warning system;

(b) an unitary lighting fixture comprising:

(i) a first lighting apparatus for providing light intensity for general room illumination, responsive to arbitrary on-off control by an on-site person occupying said room through manual operation of an electrical power switch;

(ii) a second visual alarm and signal apparatus, having peak light intensity levels in a range exceeding said intensity level of said general room illumination, automatically responsive, irrespective of the then prevailing on-off mode of operation of said first illumination apparatus, to said electrical controls of said alarm and signaling systems, and operable in fully-off-to-fully-on pulsed mode to deliver said peak light intensity levels within said room zones at levels sufficient to alert a hearing impaired person and persons in the inattentive mental states and for communicating designated warnings of one or multiple situations to observant persons, should any said persons then be within said room, comprising:

a strobe lamp;

means for operating said strobe lamp so as to produce high intensity flashes of light for said alerting a hearing impaired person and for said communicating designated warnings; and an enclosure for said strobe lamp comprising a partially globular sheel, of substantially transparent light transmitting material, having a multiplicity of crystalline formations on a surface thereof for an enhancement of said flashing strobe lamp.

5. An electrical lighting and visual warning system, according to claim 4, wherein said second apparatus still further comprises:

(a) a strobe lamp;

(b) means for operating said strobe lamp so as to produce high intensity flashes of light for said alerting a hearing impaired person and for said communicating designated warnings;

(c) at least one colored incandescent signaling lamp for further communicating designated warnings.

6. An electrical lighting and visual warning system, according to claim 4, wherein said second apparatus still further comprises:

(a) a means for supplying control power;

(b) at least one alarm condition sensor;

(c) a control relay for said strobe lamp, said control relay responsive to application of said control power by the activation of said alarm condition sensor, whereby said control relay applies said house power to operate said strobe lamp at defined flashing rates, representing at least one designated warning situation.

7. An electrical lighting and visual warning system, according to claim 5 or 6, still further comprising an embodiment in a form of a portable table lamp, said table lamp embodiment comprising:

(a) a first subassembly of said second apparatus comprising a base for said table lamp;

(b) a second subassembly of said first apparatus for said general room illumination comprising:

means for support and attachment of said second subassembly in a superimposed position to said table lamp base;

an electrical switch, operable by said on-site person, occupying said room, for application of said power to said first apparatus;

an illuminating lamp for said general illumination of said room zones;

a socket for said illuminating lamp;

a shade for diffusing the illumination from said lamp;

a harp for support and attachment of said diffuser shade to said lamp socket; and (c) means for connecting said portable table lamp to said power, said alert and alarm signaling circuits.

8. An electrical lighting and visual warning system, according to claim 5, or 6, still further comprising an embodiment in a form of a suspended swag fixture, said swag fixture comprising:

(a) a means for suspending said fixture from an overhead support;

(b) said second apparatus for said production of high intensity light;

(c) a cover plate, horizontally disposed, to the under side of which said second apparatus is assembled;

(d) an illuminating lamp for said general illumination of said room zones;

(e) an electrical switch, operable by said on-site person, for application of said power to said illuminating lamp;

(f) a socket for said illuminating lamp;

(g) a harp, enclosing said illuminating lamp and said socket, for connecting from the top side of said cover plate to said means of suspending said fixture from said overhead support; and (h) a shade, supported by interposing its frame between said harp and said means for suspending said fixture, for enclosing said illuminating lamp and for diffusing said general illumination obtained therefrom.

9. An electrical lighting and visual warning system, according to claim 5, or 6, still further comprising an embodiment in a form of a ceiling fixture, said ceiling fixture comprising:

(a) a support plate and collar for attachment to a ceiling;

(b) an illuminating lamp for said general illumination of said room zones;

(c) means for suspending said illuminating lamp from said support plate;

(d) means for suspending said strobe lamp from a central location of said support plate;

(e) a complex globular light transmitting shell, for attachment within said collar, comprising:

a central portion for enclosure of said strobe lamp therein, made of said substantially transparent material and having a multiplicity of said crystalline formations on a surface thereof for enhancement of said flashing strobe lamp; and a second portion thereof, disposed about the perimeter of said central portion, for enclosing said incandescent signaling and general illumination lamps therein, said second portion having translucent properties for diffusion of light from said incandescent signaling and illuminating lamps.

10. An electrical lighting and visual warning system for the living and working zones of a room, comprising:

(a) a control box comprising means for connecting said lighting and warning system to AC house wiring for power and for interfacing an alarm and signaling system;

(b) an unitary lighting fixture comprising:

a first general room illumination apparatus, responsive to arbitrary on-off control by an on-site person occupying said room, comprising:

an electrical power control switch for manual operation by said on-site person;

an illuminating lamp responsive to said arbitrary on-off control, for constant illumination of said room zones;

a shade for diffusing said constant illumination; and a second visual alarm and signal apparatus, having peak light intensity levels in a range exceeding the maximum level of said first apparatus room illumination, automatically responsive, irrespective of the then prevailing on-off mode of operation of said first illumination apparatus, to electrical controls of said alarm and signal systems, operable in a fully-off-to-fully-on pulsed mode to deliver said peak light intensity levels within said room zones at levels sufficient to alert a hearing impaired person and persons in the inattentive mental states and for communicating designated warnings of one or multiple situations to observant persons, should any said persons then be within said room, said second apparatus comprising:

a strobe lamp for producing said pulsed light levels;

means for operating said strobe lamp in said fully-off-to-fully-on pulsed mode at at least one defined flashing rate for said communicating designated situation warnings;

at least one colored incandescent lamp for said communicating designated warnings of additional situations; and an enclosure for said strobe and said colored incandescent lamps comprising a partially globular shell of substantially transparent light transmitting material, having a multiplicity of cyrstalline formations on a surface thereof for an enhancement of said strobe lamp.

11. An electrical lighting and visual warning system, according to claim 10, still further comprising an embodiment in a form of a portable table lamp, said table lamp embodiment comprising:

(a) a first subassembly of said second apparatus comprising a base for said table lamp;

(b) a second subassembly of said first apparatus for said general room illumination comprising:

means for support and attachment of said second subassembly in a superimposed position to said table lamp base;

said electrical switch, manually operable by said on-site person, for application of said power to said first apparatus;

said illuminating lamp, responsive to said manual switch operation;

a socket for said illuminating lamp;

said shade for diffusing said illumination from said illuminating lamp;

a harp for support and attachment of said diffuser shade to said lamp socket; and (c) means for connecting said portable lamp to said control box for said power and for said interfacing of said alarm and signal system.

12. An electrical lighting and visual warning system, according to claim 10, still further comprising an embodiment in a form of a ceiling fixture, said ceiling fixture comprising:

(a) a support plate and collar for attachment to a ceiling;

(b) said illuminating lamp for general illumination of said living and working zones of said room;

(c) means for suspending said illuminating lamp from said support plate;

(d) means for suspending said strobe lamp from a central location of said support plate;

(e) a complex globular light transmitting shell, for attachment within said collar, still further comprising:

a central portion for enclosure of said strobe lamp therein, made of substantially transparent material and having a multiplicity of said crystalline formations on a said surface thereof for enhancement of said flashing strobe lamp; and a second portion thereof, disposed about the perimeter of said central portion, for enclosing said incandescent signaling and general illumination lamps therein, said second portion having translucent properties for diffusion of light from said illuminating lamp.

13. An electrical lighting and visual warning system, according to claim 10, still further comprising an embodiment in a form of a suspended swag fixture, said swag fixture comprising:

(a) a means for suspending said fixture from an overhead support;

(b) said second apparatus for said production of high intensity light;

(c) a cover plate, horizontally disposed, to the under side of which said second apparatus is assembled;

(d) said illuminating lamp for said general illumination of said living and working zones of said room;

(e) said elecrical switch, operable by said on-site person, for application of said power to said illuminating lamp;

(f) a socket for said illuminating lamp;

(g) a harp, enclosing said illuminating lamp and said socket, for connecting from the top side of said cover plate to said means of suspending said fixture from said overhead support;

(h) said shade, supported by interposing its frame between said harp and said means of suspending said fixture, for enclosing said illuminating lamp and for diffusing said general illumination obtained therefrom; and (i) means for connecting said swag fixture to said control box for said power and for said interfacing of said alarm and signal system.

* * * * *